US007573458B2

(12) United States Patent
Dunn

(10) Patent No.: US 7,573,458 B2
(45) Date of Patent: Aug. 11, 2009

(54) WIDE FLAT PANEL LCD WITH UNITARY VISUAL DISPLAY

(75) Inventor: William R. Dunn, Alpharetta, GA (US)

(73) Assignee: American Panel Corporation, Alpharetta, GA (US)

( * ) Notice: Subject to any disclaimer, the term of this patent is extended or adjusted under 35 U.S.C. 154(b) by 537 days.

(21) Appl. No.: 11/005,156

(22) Filed: Dec. 3, 2004

(65) Prior Publication Data

US 2008/0284694 A1 Nov. 20, 2008

(51) Int. Cl.
*G09G 3/36* (2006.01)

(52) U.S. Cl. ..... 345/103; 345/690

(58) Field of Classification Search ..... 345/87, 345/103, 1.3, 690
See application file for complete search history.

(56) References Cited

U.S. PATENT DOCUMENTS 4,740,786 A * 4/1988 Smith ..... 345/3.1
4,816,816 A * 3/1989 Usui ..... 345/103
5,387,923 A * 2/1995 Mattison et al. ..... 345/103
5,617,113 A * 4/1997 Prince ..... 345/103
5,668,569 A * 9/1997 Greene et al. ..... 345/103
5,889,568 A * 3/1999 Seraphim et al. ..... 349/73
5,945,974 A * 8/1999 Sharma et al. ..... 345/98
6,020,868 A * 2/2000 Greene et al. ..... 345/88
6,115,092 A * 9/2000 Greene et al. ..... 349/74
6,181,392 B1 * 1/2001 Greene et al. ..... 349/74
6,215,459 B1 * 4/2001 Reddy et al. ..... 345/3.1
6,256,010 B1 7/2001 Chen ..... 345/147
6,271,825 B1 * 8/2001 Greene et al. ..... 345/694
6,731,259 B2 5/2004 Yer ..... 345/89
6,809,746 B2 * 10/2004 Whittington et al. ..... 345/690
6,917,348 B2 * 7/2005 Demsky et al. ..... 345/1.1
6,941,160 B2 * 9/2005 Otsuka et al. ..... 455/566
7,158,127 B1 * 1/2007 Dotson ..... 345/204
2002/0154089 A1 * 10/2002 Yamazaki et al. ..... 345/103
2002/0196226 A1 * 12/2002 Tegreene et al. ..... 345/103
2003/0058136 A1 * 3/2003 Hedrick ..... 340/973
2004/0150582 A1 * 8/2004 Dunn ..... 345/1.3
2005/0041045 A1 * 2/2005 Plut ..... 345/660
2005/0140642 A1 * 6/2005 Chiu et al. ..... 345/103
2007/0030223 A1 * 2/2007 Moon ..... 345/87

* cited by examiner

*Primary Examiner*—Ricardo L Osorio
(74) *Attorney, Agent, or Firm*—Standley Law Group LLP

(57) ABSTRACT

A flat panel display, particularly a liquid crystal display has a front plate with a plate area defined by a plate perimeter, which is in turn defined by a first and second pair of parallel sides, the pairs of sides in perpendicular relationship to each other. An active display area providing a unitary visual display is located within the plate perimeter. In the invention, this active display area is divided into at least first and second display areas, a visual output of said first and second display areas being separately driven. In some embodiments, one or both of the display areas is subdivided into first and second subdisplay areas, with the visual output of the first and second subdisplay areas being separately driven.

23 Claims, 4 Drawing Sheets

WIDE FLAT PANEL LCD WITH UNITARY VISUAL DISPLAY

TECHNICAL FIELD

The present invention relates generally to display devices, and more particularly, to flat panel display devices that use liquid crystal display (LCD) technology. The present invention relates to a flat panel LCD having a sufficient area that it comprises a pair of side by side displays that are driven from opposing sides. The present invention provides an arrangement and method to provide a unitary display by eliminating a visual seam effect down a junction line across the panel between the two displays.

BACKGROUND OF THE ART

Flat panel displays using liquid crystal display (LCD) technology are widely known and have found application in a number of fields for displaying visual information. In a flat panel LCD, the screen area, which is substantially rectangular, is divided into a large number of individual color dots. Each set of color dots is capable of displaying a full color gamut. It is known for the sets to comprise a three-dot combination of red, green and blue, a four-dot combination of red, green, green and blue, a four-dot combination of red, green, blue and white, and a six-dot combination of red, green, blue, yellow, cyan and magenta, as well as other combinations that allow a full color display. In an active matrix flat panel LCD, each color dot contains a transistor switch. A liquid crystal fluid, contained between a front plate and a rear plate, is twisted by a voltage which changes the axis of polarization of light, allowing the individual color dots to transmit or block light passing from a backlight source through the individual color filters. The color dots are arranged in a grid comprising rows and columns, and there can be several hundred or thousand vertical columns of color dots going across the display as well as hundreds or thousands of horizontal rows of color dots, resulting in most cases in more than 1,000,000 individual color dots. Each color dot has a vertical column and horizontal row grid address and is driven by electrical impulses fed along its respective row from a bus located on one of the side edges of the flat panel LCD and along its respective column from a top or bottom edge of the flat panel LCD. In general, the horizontal row drivers are referred to as gate drivers and the vertical column drivers are referred to as source drivers, but these may be reversed in practice, as will be known to those of skill in this art. In either case, the source driver signal provides the gray scale data for a given color dot, while the gate driver signal changes a given line of thin film transistors ("TFTs") from "off" to "on" for a given "line time." This signal from the gate driver thereby allows the charging of a capacitor associated with the individual color dot, determining the voltage held by the color dot for an entire frame period.

In some critical applications, especially in vehicle applications where the overall display area is limited but it is desired to maximize image area while providing a degree of redundancy, the display area should be divided into at least one pair of side by side display areas, while retaining the visual impression of a single panel. However, since color dots near a junction line between the two adjacent display areas receive their respective signals from opposite sides of the display, these signals are vulnerable to a mismatch of their photometrics. If this is not corrected, a visually perceptible seam will occur along that junction line.

The very nature of a display panel dictates that a central portion of the panel contains the most critical information for the user. For example, critical electronic flight indicators such as the horizontal situation indicator (HSI), the attitude direction indicator (ADI), the altimeter and the air speed indicator will be located centrally on the panel, to be readily accessible to a pilot. In a large display panel, especially one that has a significantly large number of columns of color dots, as an "all glass" cockpit would have, it is desirable to drive side by side displays that define the overall panel display. However, this can place the distraction of a visually perceptible centerline or seam at the point of focus for the user.

Although this need has been initially described with reference to electronic flight indicator applications of flat panel LCDs, the need extends to a variety of other flat panel LCD applications, and the present invention is applicable to these other applications.

It is, therefore, an unmet objective of the prior art to mate a pair of side by side display areas on a single flat panel LCD, such that there is no visibly perceptible seam line along a junction line between the side by side display areas.

SUMMARY OF THE INVENTION

This and other objectives of the present invention are achieved by a flat panel liquid crystal display ("LCD") with a front plate with a plate area defined by a plate perimeter having a first and second pair of parallel sides, the pairs of sides in perpendicular relationship to each other, so that an active display area provides a unitary visual display within said plate perimeter. Such an active display area is divided into at least first and second display areas, a visual output of said first and second display areas being separately driven.

In some embodiments, at least one of the first and second display areas is further subdivided into first and second subdisplay areas, a visual output of said first and second subdisplay areas being separately driven.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF A PREFERRED EMBODIMENT

Figure 1:
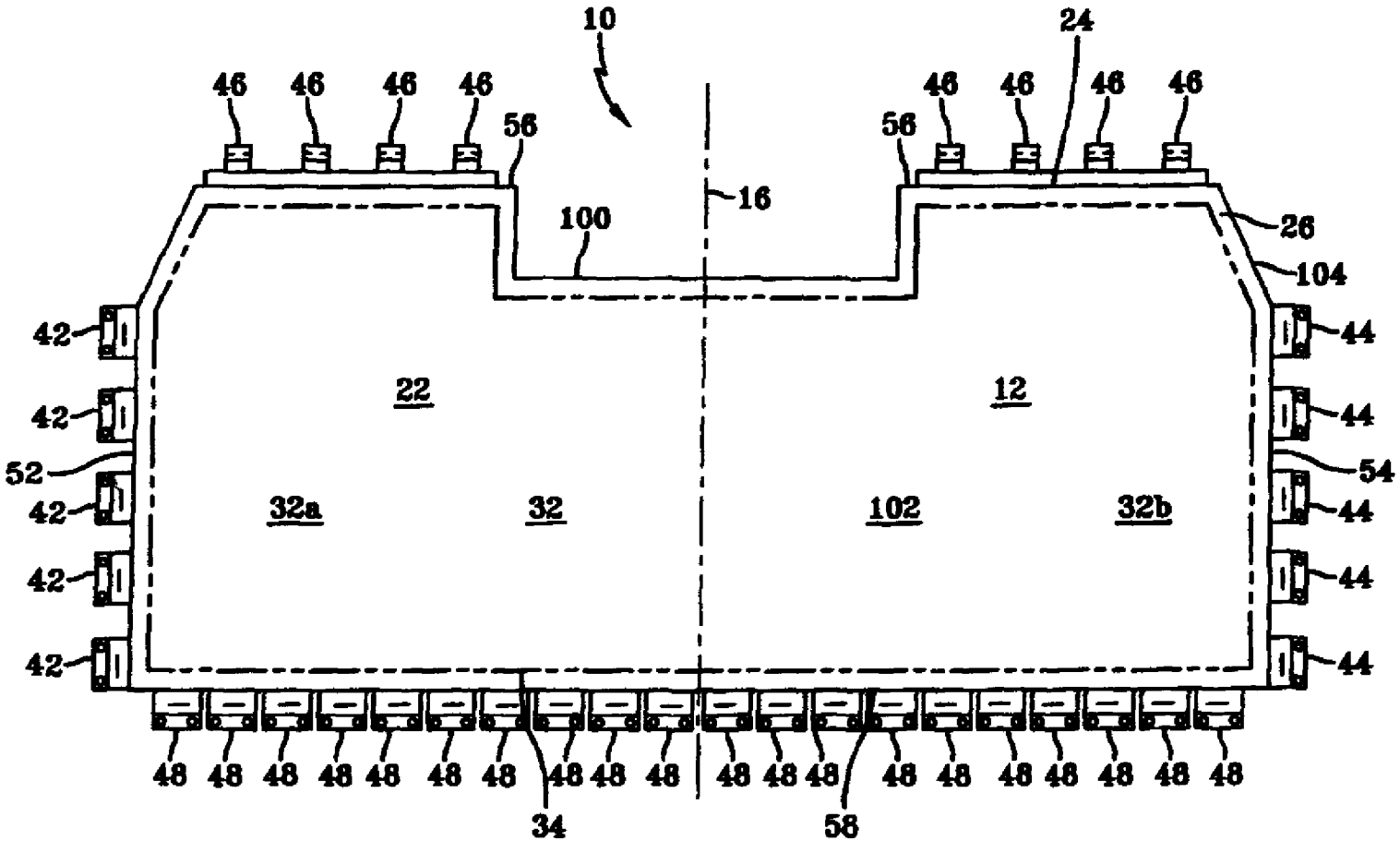
FIG. 1 shows a front elevational view of a flat panel LCD of the present invention, divided into first and second display areas.

FIG. 1 shows a front elevational view of an embodiment of the flat panel LCD 10 of the present invention. In the particular embodiment taught herein, the flat panel LCD 10 is intended for use as an instrument panel 100 for an aircraft. An available instrument panel area 102 on the instrument panel 100 is defined by and enclosed within a panel perimeter 104. The flat panel LCD 10 is comprised of front and rear plates, but only front plate 12 is visible in FIG. 1, with rear plate (not shown in FIG. 1) being identically dimensioned. Front plate 12 has a plate area 22 defined by and enclosed within a plate perimeter 24. An active display area 32 of front plate 12 is not quite as large as the plate area 22. A portion 26 of the plate area 22 just inside the entire plate perimeter 24 is occupied by a width of sealing adhesive that is needed for forming a thin cavity, which retains an amount of liquid crystal material between the front plate 12 and the rear plate. Accordingly, plate area 22 is effectively the sum of the active display area 32 and the portion 26 occupied by the sealing adhesive. Active display area 32 is also defined by and enclosed within display perimeter 34. For reasons related to the particular application, that is, as an aircraft instrument panel 100, the front and rear plates 12, 14 are not rectangular, but the present invention is not limited to a non-rectangular flat panel LCD 10. In fact, many of the important applications will involve a rectangular flat panel LCD.

In the embodiment illustrated in FIG. 1, a plurality of means for communicating an electrical driver signal to the plate perimeter 24 are provided. As will be known to one of skill in this art, the driver signals will comprise gate and source driver signals. There are a number of known means for communicating that may be used, including chip on film (COF), chip on glass (COG), tape-automated bonding (TAB) and others. As illustrated, a first set of communicating means 42 is located along a left side edge 52, with a corresponding set of communicating means 44 located along a right side edge 54. Connections 46, located along a top edge 56, are intended for use with a panel heater system and not for delivering a driver signal, so the particular flat panel display 10 of FIG. 1 cannot be divided into four separate display areas. A single set of communicating means 48 is located along the bottom edge 58. All communicating means 42, 44 and 48 are aligned for parallel connection to appropriate driver circuits (not shown), as is known in the art.

In a flat panel LCD 10 having the aspect ratio illustrated, it is desirable to divide the active display area 32 into a pair of side by side display areas 32*a*, 32*b*, with a vertical centerline 16 of the panel 10 defining the border between the side by side display areas. In the particular embodiment shown, the active display area 32 has an aspect ratio (defined here as the maximum width to the maximum height) of about 2.6:1, so splitting the active display area in this manner effectively halves the aspect ratio of each individual display area 32*a* or 32*b* to about 1.3:1. In doing this, the bottom communicating means 48 will both provide driving signals (typically a source driver signal) to the display areas 32*a* and 32*b*, with the communicating means 48 to the left of centerline 16 driving display area 32*a* and communicating means 48 to the right of centerline 16 driving display area 32*b*. Communicating means 42 will provide a driver signal (typically a gate drive) to display area 32*a* and communicating means 44 will provide a similar signal to display area 32*b*.

It is noteworthy that display areas 32*a* and 32*b* are not physically separated by any non-active area, such as the non-active portion 26 that has the sealing adhesive. For that reason, there should be no abrupt change in the photometric characteristics of the active display 32 along centerline 16.

Figure 2:
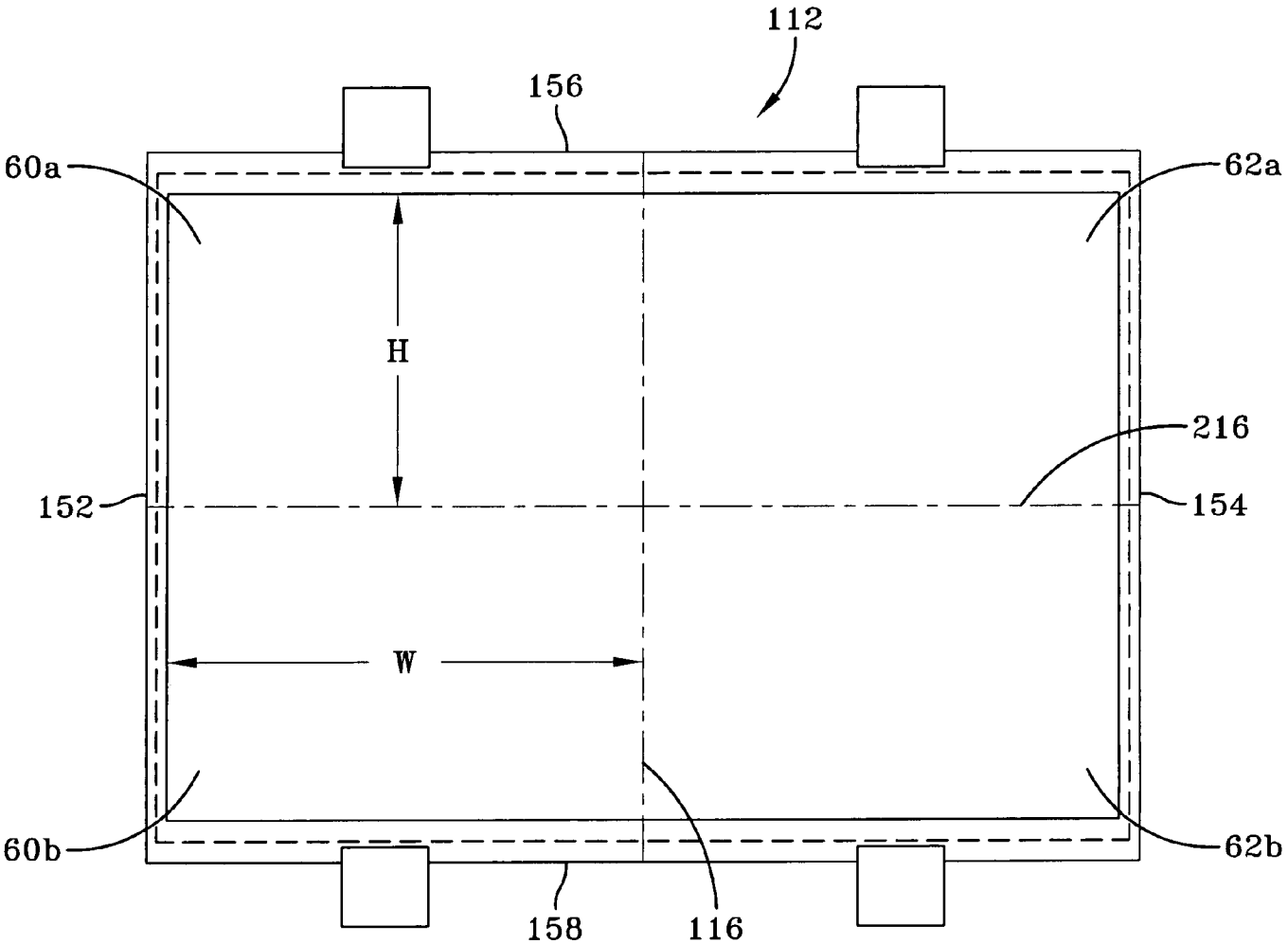
FIG. 2 shows an idealized rectangular flat panel LCD divided and subdivided into display areas and subdisplay areas.

While FIG. 1 shows a particular application of the inventive concept in an instrument panel 10 with first and second display areas 32*a*, 32*b*, the invention may be also applied to a more generalized panel of FIG. 2, exemplified by a front plate 112, in which the abrupt change known in the prior art is prevented. FIG. 2 shows a somewhat idealized front plate 112 with a unitary visual display area that is not just divided into two display areas 60, 62 separated by a vertical centerline 116, but each of these display areas 60, 62 is further subdivided by a horizontal centerline 216, resulting in the four display areas 60*a*, 60*b*, 62*a* and 62*b*, where area 60 is equivalent to display area 32*a* of FIG. 1 and area 62 is equivalent to display area 32*b*. Front plate 112 has a pair of first sides 152, 154 and a pair of second sides 156 and 158. The first sides 152, 154 are parallel to each other and are perpendicular to the second sides 156, 158, which are parallel to each other. Vertical centerline 116 acts as a junction line, and its dotted nature in the FIG. shows that it is present, but not visually perceptible. The perimeter of display area 60 consists of first side 152, a first portion of second side 156, the junction line 116 and a first portion of second side 158. Similarly, the perimeter of display area 62 consists of first side 154, the remaining portion of second side 156, the junction line 116 and the remaining portion of second side 158. By applying a set of either gate or source drivers along sides 152, 154 and a set of the other type of drivers along either side 156 or 158, display areas 60 and 62 are separately driven.

It is further possible to subdivide one or both of display areas 60, 62 into two separately driven subdisplay areas 60*a* and 60*b* or 62*a* and 62*b*. This is done by using the horizontal centerline 216 as a subjunction line, where its dotted nature in the FIG. shows that it is present, but not visually perceptible. The perimeter of display area 60*a* consists of a portion of first side 152, the subjunction line 216, a portion of the junction line 116 and a first portion of second side 158. Similarly, the perimeter of display area 60*b* consists of the remaining portion of first side 152, a portion of second side 156, a portion of the junction line 116 and the subjunction line 216. By applying a set of either gate or source drivers along portions of side 152 and a set of the other type of drivers along the portions of second sides 156 and 158, display areas 60*a* and 60*b* are separately driven. From this, it is clear how display area 62 may be similarly subdivided into subdisplay areas 62*a*, 62*b*.

While the example shows the active display area being divided equally between the first and second display areas 60, 62 and each of the display areas being subdivided equally into subdisplay areas 60*a*, 60*b* and 62*a*, 62*b*, it will be clear that the divisions brought about by junction line 116 and/or subjunction line 216 need not be equal for the advantages of the present invention to be obtained.

Figure 3:
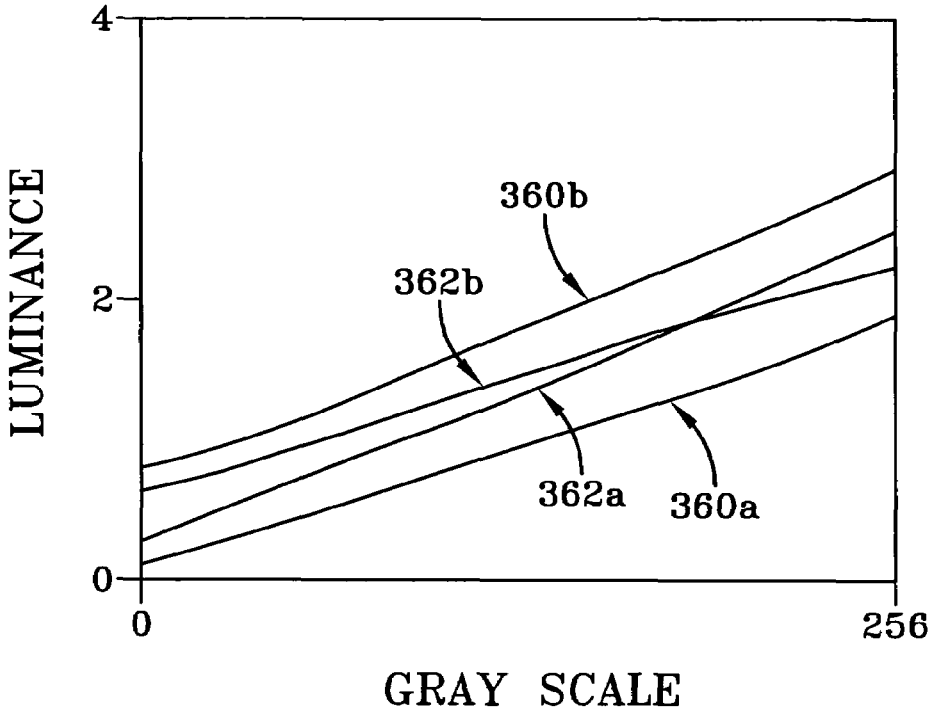
FIG. 3 shows a hypothetical graph of a gamma curve for a prior art flat panel LCD device.

Because display areas 60*a*, 60*b*, 62*a* and 62*b* are separately powered and driven, it is to be expected that the overall visual image presented upon initial powering will not be the desired unitary visual display that would be expected if only a single powering and driving source was provided. Accordingly, the differences between the respective display areas will result in visual seam lines along the junction and subjunction lines. One example of such difference can be due to differences in the gamma curves obtained in each display area. The gamma curve is a plot of the luminance of the display as a function of the gray scale value. FIG. 3 is a hypothetical example of a gamma plot showing curves 360*a*, 360*b*, 362*a* and 362*b* as measured from corresponding display areas 60*a*, 60*b*, 62*a* and 62*b* for a display panel as shown in FIG. 2.

Figure 4:
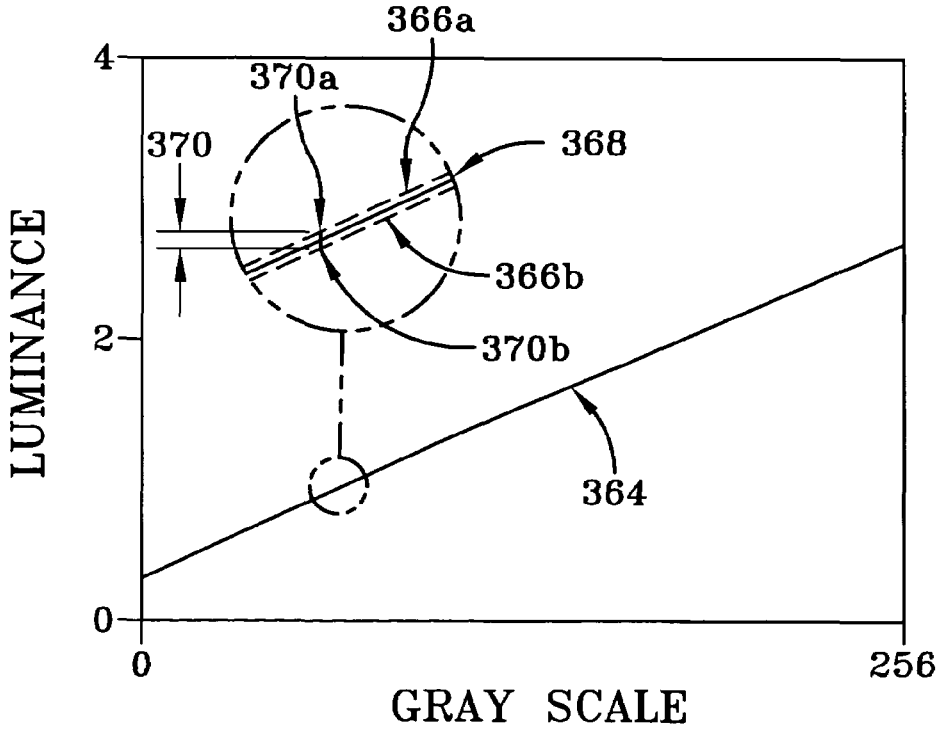
FIG. 4 shows a hypothetical graph of a common gamma curve for a flat panel LCD device employing the present invention.

Once curves 360*a*, 360*b*, 362*a* and 362*b* are determined, then each curve may be adjusted to a common curve 364 as shown in FIG. 4, using known techniques, such as the technique taught in commonly-owned U.S. Pat. No. 6,809,746, which is incorporated by reference as if fully recited herein. As shown in an enlarged portion of FIG. 4, curve 364 is actually a corridor 368 defined by upper limit curve 366*a* and lower limit curve 366*b*, each of which may be set arbitrarily close to curve 364. For a given value 370 of gray scale, the measured luminance can vary from a low limit value 370*a* to a high limit value 370*b* and still lie within corridor 368. The amount of variance, that is, the vertical distance between 370*b* and 370*a* along line 370, can be different between applications, but each of the curves should be adjusted so that it lies in corridor 368 across the entire range of gray scale. When this occurs, any abrupt change along a junction line or subjunction line is eliminated and a unitary visual image is provided.

In contrast to the gamma curve, in which luminance is a function of gray scale value, there are measurable video output parameters that are dependent upon distance from the driving edge. Note in the embodiment shown in FIG. 2 that the perpendicular distance from side 152 (which serves as a driving edge in subdisplay areas 60*a* and 60*b*) to junction line 116 is designated as W and that the perpendicular distance from side 156 (which serves as a driving edge in subdisplay areas 60*a* and 62*a*) to subjunction line 216 is designated as H. If one measures any one of several video output parameters as one moves along a straight line from a driving side edge (such as side 152) to the junction or subjunction line opposite that edge in the display or subdisplay area, a plot may be made of that video output parameter against a normalized distance D, which in this case we will define as a ratio of the distance between the driving side and measurement point to the total distance between the driving side and the junction or subjunction line. In other words, D increases from 0 to 1 as the measurement point moves from the driving side to the junction line or subjunction line.

Figure 5:
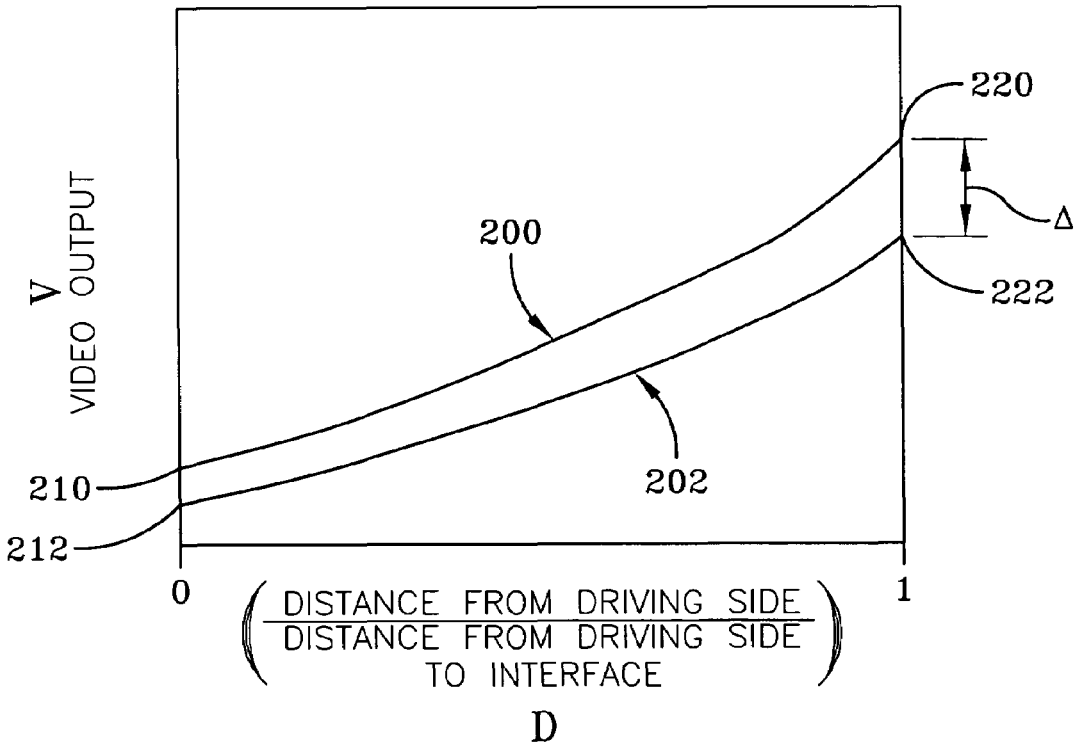
FIG-5 PRIOR ART
FIG. 5 shows a graph of a video output parameter plotted against a dimensionless distance parameter for a prior art flat panel LCD device.

In hypothetical depiction of the abrupt change that would be expected in the prior art, or in an unremediated device of the present invention, a video output parameter V is plotted as a function of this normalized distance D, as shown in FIG. 5. In the hypothetical graph, curve 200 represents a measurement of video output parameter V as taken while moving vertically from left to right across display area 60 to junction line 116 and curve 202 represents the measurement of the identical video output parameter V as moving vertically in the same line, but from right to left, across display area 62. It is relatively inconsequential that the curves may be offset from each other when D=0, that is, at points 210, 212 on the respective curves. This is because these measurements are made at the driving edges of the display, that is, as far apart vertically from each other as possible. However, an unacceptable situation is shown by the disparity at points 220 and 222. This difference Δ in the video output parameter at D=1, that is, along the junction line 116 or interface, means that there is a visually perceptible seam line, due to the sudden discontinuity in the video output parameter as one moves across the junction line 116 between the respective display areas.

Figure 6:
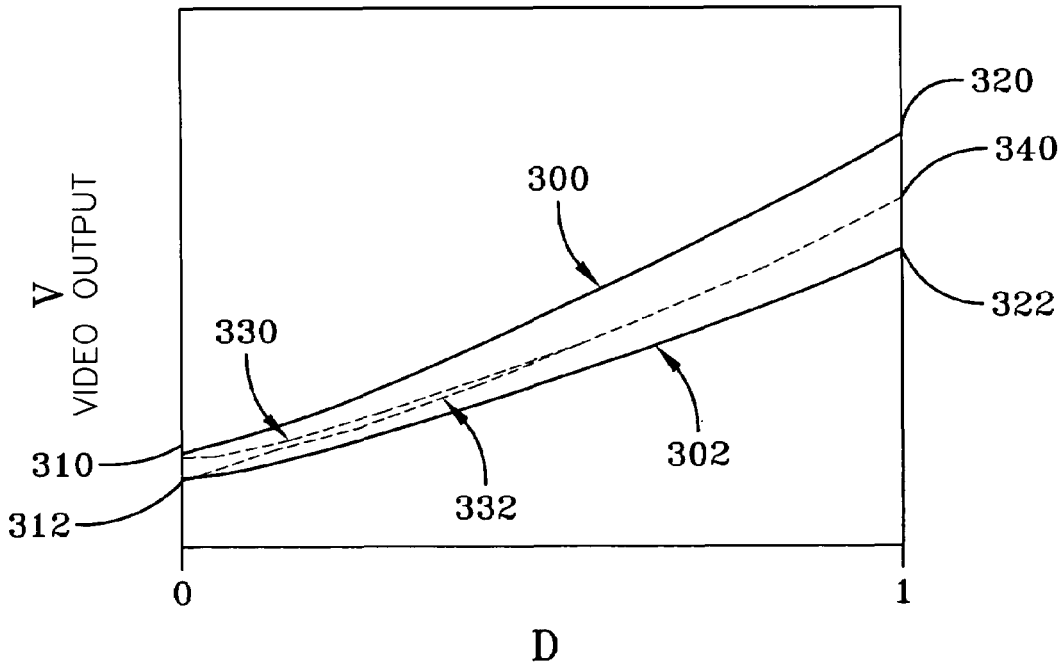
FIG. 6 shows a graph similar to FIG. 5, but employing the present invention method.

The solution of the present invention is to employ a normalization technique, as described further below. This is shown graphically in FIG. 6, which shows a hypothetical graph, similar to that of FIG. 5. However, FIG. 6 shows two initial hypothetical curves, with curve 300 representing the performance of a first display area and curve 302 representing the performance of an adjacent second display area. Again, it is relatively inconsequential that the curves 300, 302 may be offset from each other when D=0, that is, at points 310, 312 on the respective curves. By employing the inventive method, the prior disparity Δ is effectively eliminated by changing the performance of the first display area from that of curve 310 to that of curve 330 and changing the performance of the second display area from that of curve 312 to that of curve 332. When that is accomplished, curves 330 and 332 are coincident at D=1, that is, at point 340, or at least differ from each other by an amount no greater than a predetermined maximum disparity δ, this predetermined maximum disparity being an amount that that is not visibly perceptible to most users. In a more preferred embodiment of the invention, curves 330 and 332 vary from each other by less than δ for given values of D over the entire range of from 0.95 to 1, that is, within 5% of D, and in the most preferred embodiments, curves 330 and 332 vary from each other by less than δ for given values of D over the entire range of from 0 to 1.

Those of skill in this art will be able to properly select one or more video output parameter from the group consisting of: peak brightness, contrast, and white point color temperature.

Just as a vertical junction line 116 may be rendered visually imperceptible through this method, the same method may be used to eliminate a horizontal subjunction line such as 216 that subdivides a display area such as 60 into subdisplay areas 60*a* and 60*b*.

The method of the present invention has particular application when the active display area of a panel such as panel 10 has an aspect ratio of at least 2.2 and the junction line 116 is a centerline of the front plate 12. The method also has particular application when the active display area is adapted for use as an aircraft instrument panel.

In practice, the normalization of the video output parameter curves shown in FIG. 6 is accomplished by providing a flat panel LCD having a front plate for providing the unitary visual display in first and second display areas joined along a junction line, activating the respective first and second display areas and measuring the value of at least one video output parameter at a plurality of correspondingly positioned first and second points in the respective display areas, and tuning at least one of the respective driving circuits that drive the first and second display areas, so that a difference between the measured values for each video output parameter of each said pair of points is smaller than a predetermined allowable variance.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A flat panel liquid crystal display ("LCD"), comprising:

a front plate with a plate area defined by a plate perimeter defined by a first and second pair of parallel sides, the pairs of sides in perpendicular relationship to each other, and an active display area providing a unitary visual display within said plate perimeter;

said active display area divided into at least first and second display areas, a visual output of said first and second display areas being separately driven and powered; and said first and second display areas comprising subpixels, said subpixels having subpixel voltages, said subpixel voltages adjusted to a desired optical transmission, wherein gamma curves of each display area are set to a common gamma curve across a range of gray scale values to provide the unitary visual display.

2. The flat panel LCD of claim 1, wherein:

said first display area is defined by a perimeter consisting of one of the first set of parallel sides, a junction line passing across the plate parallel to said one of the first set of parallel sides and a first portion of each of the second set of parallel sides;

said second display area is defined by a perimeter consisting of the other of the first set of parallel sides, the junction line, and a remaining portion of each of the second set of parallel sides; and the visual output of each of the first and second display areas is driven by a gate driver signal and a source driver signal received along the respective display perimeter, with one of the driver signals for each of the display areas being received along the one of the first set of parallel sides and the other driver signal being received along one of the two portions of the second set of parallel sides.

3. The flat panel LCD of claim 2, wherein:

the active display area is divided equally between the first and second display areas.

4. The flat panel LCD of claim 2, wherein:

at least one of the first and second display areas is further subdivided into first and second subdisplay areas, a visual output of said first and second subdisplay areas being separately driven.

5. The flat panel LCD of claim 4, wherein:

each said first subdisplay area is defined by a perimeter consisting of a portion of one of the first set of parallel sides, a portion of the junction line passing across the plate parallel to said one of the first set of parallel sides, one of the portions of the one of the second set of parallel sides and a subjunction line that passes across the subdisplay area parallel to the one portion of the one of the second set of parallel sides;

each said second subdisplay area is defined by a perimeter consisting of the other portion of the one of the first set of parallel sides, the remaining portion of the junction line, the other portion of the one of the second set of parallel sides and the subjunction line; and the visual output of each of the first and second subdisplay areas is driven by a gate driver signal and a source driver signal received along the respective subdisplay perimeter, with the one of the driver signals for each of the subdisplay areas being received along the portion of the first set of parallel sides and the other driver signal being received along the portion of the second set of parallel sides.

6. The flat panel LCD of claim 4, wherein:

each display area is divided equally between the first and second subdisplay areas.

7. The flat panel LCD of claim 4, wherein:

a gamma curve generated from the visual output of each said subdisplay area is adjusted to be arbitrarily close to a common gamma curve across a range of gray scale values to provide the unitary visual display.

8. The flat panel LCD of claim 4, wherein:

a measurement of a video output parameter at a point of the first display area along any line perpendicular to the junction line and at a distance therefrom differs by less than a predetermined amount from a measurement of the video output parameter at a corresponding point of the second display area along the same perpendicular line, when the distance is less than 5% of a total distance from the one of the first set of parallel sides to the junction line; and a measurement of a video output parameter at a point of the first subdisplay area along any line perpendicular to the subjunction line and at a distance therefrom differs by less than a predetermined amount from a measurement of the video output parameter at a corresponding point of the second subdisplay area along the same perpendicular line, when the distance is less than 5% of a total distance from the one of the second set of parallel sides to the subjunction line.

9. The flat panel LCD of claim 8, wherein:

the video output parameter is selected from the group consisting of: peak brightness, contrast, and white point color temperature.

10. The flat panel LCD of claim 2, wherein:

a measurement of a video output parameter at a point of the first display area along any line perpendicular to the junction line and at a distance therefrom differs by less than a predetermined amount from a measurement of the video output parameter at a corresponding point of the second display area along the same perpendicular line, when the distance is less than 5% of a total distance from the one of the first set of parallel sides to the junction line.

11. The flat panel LCD of claim 10, wherein:

the video output parameter is selected from the group consisting of: peak brightness, contrast, and white point color temperature.

12. The flat panel LCD of claim 1, wherein:

the active display area has an aspect ratio of at least 2.2.

13. The flat panel LCD of claim 1, wherein:

the junction line is a centerline of the front plate.

14. The flat panel LCD of claim 1, wherein:

the active display area is adapted for use as an aircraft instrument panel.

15. A method for manufacturing a flat panel liquid crystal display (LCD) having a unitary visual display comprising first and second display areas that adjoin along a junction line, each said display area having a width and a height, a visual output of said first and second display areas being driven by respective first and second driving circuits powered by respective first and second power sources, said first and second display areas having a range of gamma voltages extending from a black gamma voltage to a white gamma voltage, said first and second display panels comprising subpixels, said subpixels having subpixel voltages, comprising the steps of:

providing a flat panel LCD having a front plate for providing the unitary visual display;

adjusting said subpixel voltages at each particular gamma level while measuring said first and second display area's optival transmission level and fixing said subpixel voltages when a desired optical transmission level is achieved generating a gamma curve for each display area, the respective gamma curves are adjusted to be arbitrarily close to a common gamma curve across a range of gray scale values to provide the unitary visual display;

activating the respective first and second display areas and measuring the value of at least one video output parameter at a first and a second point on each of the first and second display areas, said first points and said second points of the respective display areas defining correspondingly positioned pairs of points relative to said junction line; and tuning at least one of said first and said second driving circuits such that, after such tuning step, a difference between the measured values for each said at least one video output parameter of each said pair of points is smaller than a predetermined allowable variance.

16. The method of claim 15, wherein:

the pair of correspondingly positioned first points are positioned within 5% of the width of the respective display area from the junction line.

17. The method of claim 16, wherein:

the pair of correspondingly positioned second points are positioned within 5% of the width of the respective display area from the junction line.

18. The method of claim 16, wherein:

the pair of correspondingly positioned second points are positioned within 50% of the width of the respective display area from the junction line.

19. The method of claim 15, wherein:

the at least one video output parameter is selected from the group consisting of: gray-scale, gamma, peak brightness, contrast, and white point color temperature.

20. The method of claim 15, wherein:

the predetermined allowable variance is set less than a visually perceptible difference for the at least one video output parameter.

21. The method of claim 15, wherein at least one of the first and second display areas is further subdivided into first and second subdisplay areas that adjoin along a subjunction line, each said subdisplay area having a width and a height, a visual output of said first and second subdisplay areas being driven by respective first and second driving circuits, the method further comprising the steps of:

activating the respective first and second subdisplay areas and measuring the value of at least one video output parameter at a first and a second point on each of the first and second subdisplay areas, said first points and said second points of the respective subdisplay areas defining correspondingly positioned pairs of points relative to said subjunction line; and tuning at least one of said first and said second driving circuits such that, after such tuning step, a difference between the measured values for each said at least one video output parameter of each said pair of points is smaller than a predetermined allowable variance.

22. A flat panel liquid crystal display ("LCD"), comprising:

a front plate with a plate area defined by a plate perimeter defined by a first and second pair of parallel sides, the pairs of sides in perpendicular relationship to each other, and an active display area providing a unitary visual display within said plate perimeter;

said active display area divided into at least first and second display areas, a visual output of said first and second display areas being separately driven; and said first and second display areas comprising subpixels, said subpixels having subpixel voltages, said subpixel voltages adjusted to a desired optical transmission, wherein the gamma curves of each display area are set to a common gamma curve across a range of gray scale values to provide the unitary visual display.

23. A method for manufacturing a flat panel liquid crystal display (LCD) having a unitary visual display comprising first and second display areas that adjoin along a junction line, each said display area having a width and a height, a visual output of said first and second display areas being driven by respective first and second driving circuits, comprising the steps of:

providing a flat panel LCD having a front plate for providing the unitary visual display;

generating a gamma curve for each display area, the respective gamma curves are adjusted to be arbitrarily close to a common gamma curve across a range of gray scale values to provide the unitary visual display;

activating the respective first and second display areas and measuring the value of at least one video output parameter at a first and a second point on each of the first and second display areas, said first points and said second points of the respective display areas defining correspondingly positioned pairs of points relative to said junction line; and tuning at least one of said first and said second driving circuits such that, after such tuning step, a difference between the measured values for each said at least one video output parameter of each said pair of points is smaller than a predetermined allowable variance.

* * * * *

UNITED STATES PATENT AND TRADEMARK OFFICE

CERTIFICATE OF CORRECTION

PATENT NO. : 7,573,458 B2
APPLICATION NO. : 11/005156
DATED : August 11, 2009
INVENTOR(S) : William R. Dunn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 714 days.

Signed and Sealed this

Seventh Day of September, 2010

David J. Kappos

David J. Kappos
*Director of the United States Patent and Trademark Office*